US007934279B2

(12) United States Patent
Son

(10) Patent No.: US 7,934,279 B2
(45) Date of Patent: May 3, 2011

(54) METHOD FOR SENSING A SUPPLY OF WATER TO A WATER-DROPLET GENERATOR OF A LAUNDRY MACHINE

(75) Inventor: Chang Woo Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 386 days.

(21) Appl. No.: 11/980,726

(22) Filed: Oct. 31, 2007

(65) Prior Publication Data

US 2008/0276381 A1 Nov. 13, 2008

(30) Foreign Application Priority Data

May 9, 2007 (KR) ..... 10-2007-0045135

(51) Int. Cl.
*D06F 35/00* (2006.01)
*D06B 19/00* (2006.01)
*D06B 1/02* (2006.01)

(52) U.S. Cl. ..... 8/158; 8/149.1; 8/149.2; 8/149.3

(58) Field of Classification Search ..... 8/158, 149.1, 8/149.2, 149.3
See application file for complete search history.

(56) References Cited

U.S. PATENT DOCUMENTS

| | | | | |
|---|---|---|---|---|
| 6,080,973 | A * | 6/2000 | Thweatt, Jr. | 219/497 |
| 6,534,940 | B2 * | 3/2003 | Bell et al. | 318/434 |
| 6,638,023 | B2 * | 10/2003 | Scott | 417/36 |
| 2003/0063900 | A1 * | 4/2003 | Wang et al. | 388/806 |
| 2005/0034250 | A1 * | 2/2005 | Oh et al. | 8/159 |
| 2005/0168900 | A1 * | 8/2005 | Brochu et al. | 361/93.1 |
| 2007/0113595 | A1 * | 5/2007 | Harwood et al. | 68/12.01 |
| 2007/0151129 | A1 * | 7/2007 | McAllister et al. | 38/3 |
| 2007/0258827 | A1 * | 11/2007 | Gierke | 417/6 |
| 2008/0030358 | A1 * | 2/2008 | Brochu et al. | 340/664 |
| 2008/0141550 | A1 | 6/2008 | Bae et al. | |

FOREIGN PATENT DOCUMENTS

| | | |
|---|---|---|
| CN | 1824876 A | 8/2006 |
| CN | 1944767 A | 4/2007 |
| CN | 1948594 | 4/2007 |
| DE | 102007060259 | 6/2008 |
| KR | 10-1999-0040913 | 6/1999 |
| KR | 10-0672526 | 1/2007 |
| WO | WO 2006/101312 | 9/2006 |

* cited by examiner

*Primary Examiner* — Michael Barr
*Assistant Examiner* — Charles W Kling
(74) *Attorney, Agent, or Firm* — McKenna Long & Aldridge LLP

(57) ABSTRACT

The present invention relates to a control method of a laundry machine. The control method includes inputting a command to drive the steam laundry dryer, and determining whether water is supplied to a steam generator of the steam laundry dryer. According to the control method of the steam laundry dryer, it is possible to effectively remove wrinkles from clothes and to prevent the breakage of the steam laundry dryer.

23 Claims, 6 Drawing Sheets

Fig. 6

| | Register | Data contents |
|---|---|---|
| 620 | 1 | clockwise rotation voltage value |
| | 2 | counterclockwise rotation voltage value |
| | 3 | clockwise rotation voltage value |
| | 4 | counterclockwise rotation voltage value |
| | 5 | clockwise rotation voltage value |
| | 6 | counterclockwise rotation voltage value |
| | 7 | clockwise rotation voltage value |
| | 8 | counterclockwise rotation voltage value |
| | 9 | clockwise rotation voltage value |
| | 10 | counterclockwise rotation voltage value |
| 640 | 11 | reference clockwise rotation voltage value |
| | 12 | reference counterclockwise rotation voltage value |
| 660 | 13 | measured clockwise rotation voltage value |
| | 14 | measured counterclockwise rotation voltage value |

METHOD FOR SENSING A SUPPLY OF WATER TO A WATER-DROPLET GENERATOR OF A LAUNDRY MACHINE

CROSS-REFERENCE TO RELATED APPLICATION

This application claims the benefit of Korean Patent Application No. 10-2007-0045135, filed on May 9, 2007, which is hereby incorporated in its entirety by reference in its entirety as if fully set forth herein.

BACKGROUND OF THE INVENTION

1. Field of the Invention

The present invention relates to a control method of a laundry machine, and more particularly, to a control method of a steam laundry machine that is capable of preventing the breakage of the steam laundry machine.

2. Discussion of the Related Art

A laundry drying machine is an electric home appliance that dries washed laundry, for example, washed clothes, using high-temperature air. Generally, the laundry drying machine includes a drum for receiving an object to be dried, a drive source for driving the drum, a heating unit for heating air to be introduced into the drum, and a blower unit for suctioning or discharging air into or out of the drum.

Based on how to heat air, i.e., the type of the heating unit, the laundry drying machine may be classified as an electric laundry drying machine or a gas laundry drying machine. The electric laundry drying machine heats air using electric resistance heat, whereas the gas laundry drying machine heats air using heat generated by the combustion of gas.

In addition, the laundry drying machine may be classified as a condensation type laundry drying machine or a discharge type laundry drying machine. In the condensation type laundry drying machine, air, heat-exchanged with an object to be dried in a drum and changed into a high-humidity phase, is circulated without discharging the air out of the laundry drying machine. Heat exchange is performed between an additional condenser and external air to produce condensed water, which is discharged out of the laundry drying machine. In the discharge type laundry drying machine, air, heat-exchanged with an object to be dried in a drum and changed into a high-humidity phase, is directly discharged out of the laundry drying machine.

Based on how to put laundry in the laundry drying machine, the laundry drying machine may be classified as a top loading type laundry drying machine or a front loading type laundry drying machine. In the top loading type laundry drying machine, an object to be dried is put in the laundry drying machine from above. In the front loading type laundry drying machine, an object to be dried is put in the laundry drying machine from the front.

Meanwhile, there has been developed recently a steam laundry dryer that uses steam on to remove wrinkles from the laundry.

The steam laundry dryer may include a steam generator for generating steam in the steam laundry dryer. Water is supplied to the steam generator. The water is changed into steam by the steam generator. The generated steam is supplied into a drum of the steam laundry dryer. If an appropriate amount of water is not supplied to the steam generator, the steam generator is overheated due to the shortage of water, and therefore, the steam generator may break.

SUMMARY OF THE INVENTION

Accordingly, the present invention is directed to a control method of a laundry machine that substantially obviates one or more problems due to limitations and disadvantages of the related art.

An object of the present invention is to provide a control method of a laundry machine that is capable of preventing the breakage of the laundry machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control method of a laundry machine comprising starting supplying water to a fine water-droplet generator and sensing whether water is normally supplied to the fine water-droplet generator.

The fine water-droplet generator is to generate fine droplets of water. The fine water-droplet generator turns water into fine droplets. The generator includes a steam generator to generate steam. And, the fine water-droplet generator can be a spray nozzle which is well known.

Preferably, the sensing includes sensing whether water is normally supplied from a water supply source to a pump. In case where the laundry machine includes a detachable water supply source, the sensing includes sensing whether the water supply source is operably mounted to the machine. If the water supply source is not operably mounted, namely, it is mounted in a wrong way, then water inside the water supply source may not be normally supplied to the fine water-droplet generator. When mounted after filled, it is needed to be mounted to be well connected to related components.

Preferably, the sensing includes operating a pump, which is to pump water to the fine water-droplet generator in a way that the water is supplied to the fine water-droplet generator, measuring a first voltage value of the pump, and comparing the measured first voltage value with a first reference voltage value to determine whether water is normally supplied to the fine water-droplet generator by a control unit.

Preferably, the control unit previously stores a plurality of first voltage values measured at the pump when the pump is operated and water is normally supplied to the fine water-droplet generator. The first reference voltage value can be a mean value of first voltage values.

It is preferable to determine that water is normally supplied to the steam generator when the measured first voltage value is within a predetermined range, for example, ±0.5 to 1.0 V, of the first reference voltage value.

Preferably, the control method according to the present invention can further include renewing the first reference voltage value by using the measured first voltage value. The renewing can be performed after sensing whether water is normally supplied to a fine water-droplet generator.

Further, the control method according to the present invention can include collecting the residual water from the fine water-droplet generator. The collecting of the residual water can be performed after performing an operation in which the fine water-droplet generator has been used. Preferably, the collecting includes operating the pump reversely to collect residual water from the fine water-droplet generator and sensing whether the residual water still remains. The sensing whether the residual water still remains can include measuring a second voltage value of the pump when the pump is reversely operated and comparing the measured second voltage value with a second reference voltage value.

Preferably, the control unit previously stores a plurality of measured second voltage values of the pump when the pump is operated reversely and the residual water is being collected. The second reference voltage value can be a mean value of second voltage values.

Preferably, the sensing whether the residual water still remains in the fine water-droplet generator can include sensing that the residual water still remains in the fine water-droplet generator when the measured second voltage value is within a predetermined range, for example, ±0.5 to 1.0 V, of the second reference voltage value. Namely, when the measured second voltage value is within a range from −0.5 v or −1.0 v to +0.5 v or +1.0 v from the second reference value, it is sensed that the residual water still remains.

It is preferable to further comprise renewing the second reference voltage value using the measured second voltage value.

Preferably, the renewing includes storing the measured second voltage value in the control unit, calculating a mean value of the newly stored second voltage value and the previously stored second voltage values, and storing the calculated mean value in the control unit as a new second reference voltage value.

Preferably, the sensing includes sensing that the residual water does not remain, by the control unit, when the measured second voltage value is less, by a value of a predetermined range, for example, 0.5 to 1.0 V, than the second reference voltage value. In this case, the control method according to the present invention can further include stopping the driving of the pump and informing a user that the driving of the pump is stopped.

Preferably, the sensing whether water is normally supplied to the fine water-droplet generator includes sensing that water is not normally supplied to the fine water-droplet generator, by the control unit, when the measured first rotation voltage value is less, by a value of a predetermined range, for example, 0.5 to 1.0 V, than the first reference voltage value. In this case, the control method according to the present invention can further include stopping the driving of the pump and informing a user that the driving of the pump is stopped.

Preferably, the sensing whether water is normally supplied to the fine water-droplet generator includes sensing that the pump is abnormal, by the control unit, when the measured first voltage value is greater, for example, 0.5 to 1.0 V, by a value of a predetermined range, than the first reference voltage value. In this case, the control method according to the present invention can further include sensing that the water flow is blocked by foreign matter caught in the pump. In this situation, it is preferable to perform a pump driving process to remove the foreign matter.

Preferably, the pump driving process to remove the foreign matter is carried out by repeatedly operating the pump in an alternating fashion of forward driving and reverse driving for a predetermined number of times (n, n is an integer of 2 or more).

Preferably, the control method according to the present invention further includes, when the pump driving process to remove the foreign matter is repeatedly carried out for less than the predetermined number of times, going back to the operation for supplying water to the fine water-droplet generator, and, when the pump driving process to remove the foreign matter is repeatedly carried out for the predetermined number of times or more, stopping the driving of the pump and informing a user that the driving of the pump is stopped.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 6 is a conceptional view illustrating the structure of a storage part of a control unit according to an embodiment of the present invention.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A steam laundry dryer is taken here for an embodiment of the present invention and a steam generator is applied as a fine water-droplet generator.

The structure of a steam laundry dryer, to which a control method according to the present invention is applied, will be described first, and then the control method of the steam laundry dryer according to the present invention will be described.

Figure 1:
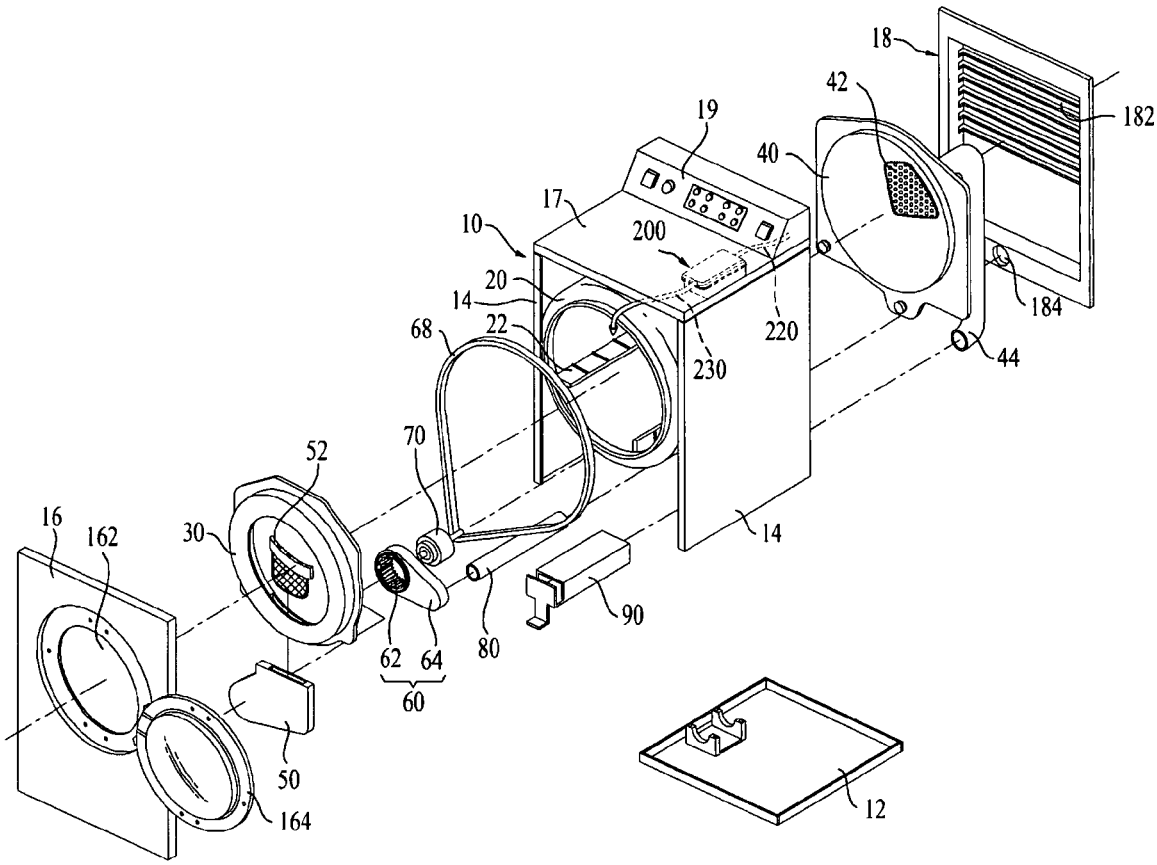
FIG. 1 is an exploded perspective view illustrating the structure of a steam laundry dryer according to an embodiment of the present invention.

FIG. 1 is an exploded perspective view illustrating the structure of a steam laundry dryer according to an embodiment of the present invention. Hereinafter, the steam laundry dryer will be described in detail with reference to FIG. 1.

A cabinet 10 forms the external appearance of the steam laundry dryer according to the present invention, and various components, which will be described below, are mounted in the cabinet 10.

In the cabinet 10 are mounted a rotary drum 20, and a motor 70 and a belt 68 for driving the drum 20. At predetermined positions, in the cabinet 10, are mounted a heater 90 (hereinafter, referred to as a "hot air heater" for convenience of description) for heating air to generate high-temperature air (hereinafter, referred to as "hot air"), and a hot air supply duct 44 for supplying hot air, generated by the hot air heater 90, into the drum 20. In the cabinet 10 are also mounted an exhaust duct 80 for discharging high-humidity air, heat-exchanged with an object to be dried in the drum 20, out of the steam laundry dryer, and a blower unit 60 for suctioning the high-humidity air. In addition, a steam generator 200, for generating high-temperature steam, is mounted at a predetermined position in the cabinet 10.

In this embodiment, an indirect drive system, in which the drum 20 is rotated using the motor 70 and the belt 68, is illustrated and described for convenience of description. However, the present invention is not limited to the indirect drive system. For example, the present invention may be applied to a direct drive system in which the motor is directly connected to the rear of the drum 20 such that the drum 20 is directly rotated by the motor.

Now, the respective components of the steam laundry dryer will be described in detail.

The cabinet 10 forms the external appearance of the steam laundry dryer. The cabinet 10 includes a base 12 constituting the bottom thereof, a pair of side covers 14 mounted vertically on the base 12, a front cover 16 and a rear cover 18 mounted at the front and rear of the side covers 14, respectively, and a top cover 17 located at the top of the side covers 14. A control panel 19, having various manipulation switches, is normally disposed at the top cover 17 or the front cover 16. To the front cover 16 is mounted a door 164. The rear cover 18 is provided with a suction unit 182, through which external air is introduced, and an exhaust hole 184, which is a final channel for discharging air in the drum 20 out of the cabinet 10.

The interior space of the drum 20 serves as a drying chamber in which a drying process is carried out. Inside the drum 20 are preferably mounted lifts 22 for lifting and dropping an object to be dried, such that the object turns over, to increase the drying efficiency.

On the other hand, a front supporter 30 and a rear supporter 40 are mounted between the drum 20 and the cabinet 10, i.e., between the drum 20 and the front cover 16 and between the drum 20 and the rear cover 18, respectively. The drum 20 is rotatably mounted between the front supporter 30 and the rear supporter 40. Between the front supporter 30 and the drum 20 and between the rear supporter 40 and the drum 20 are mounted sealing members (not shown) for preventing the leakage of air, respectively. Specifically, the front supporter 30 and the rear supporter 40 enclose the front and the rear of the drum 20 to define the drying chamber. Also, the front supporter 30 and the rear supporter 40 serve to support the front end and the rear end of the drum 20, respectively.

In the front supporter 30 is formed an opening, through which the drum 20 communicates with the outside of the steam laundry dryer. The opening is selectively opened and closed by the door 164. Also, a lint duct 50, which is a channel for discharging air in the drum 20 out of the steam laundry dryer, is connected to the front supporter 30. In the lint duct 50 is mounted a lint filter 52.

One side of the blower unit 60 is connected to the lint duct 50, and the other side of the blower unit 60 is connected to the exhaust duct 80. The exhaust duct 80 communicates with the exhaust hole 184, which is formed in the rear cover 18.

Consequently, when the blower unit 60 is operated, air in the drum 20 is discharged out of the steam laundry dryer through the lint duct 50, the exhaust duct 80, and the exhaust hole 184. At this time, foreign matter, such as lint, is filtered out by the lint filter 52. Generally, the blower unit 60 includes a blower 62 and a blower housing 64. The blower 62 is generally connected to the motor 70, which drives the drum 20.

In the rear supporter 40 is formed an opening 42 including a plurality of through-holes. The hot air supply duct 44 is connected to the opening 42. The hot air supply duct 44, communicating with the drum 20, serves as a channel for supplying hot air into the drum 20. Consequently, the hot air heater 90 is mounted at a predetermined position on the hot air supply duct 44.

On the other hand, the steam generator 200, for generating steam to be supplied into the drum 20, is mounted at a predetermined position in the cabinet 10. The details of the steam generator 200 will be described below with reference to the related drawing.

Figure 2:
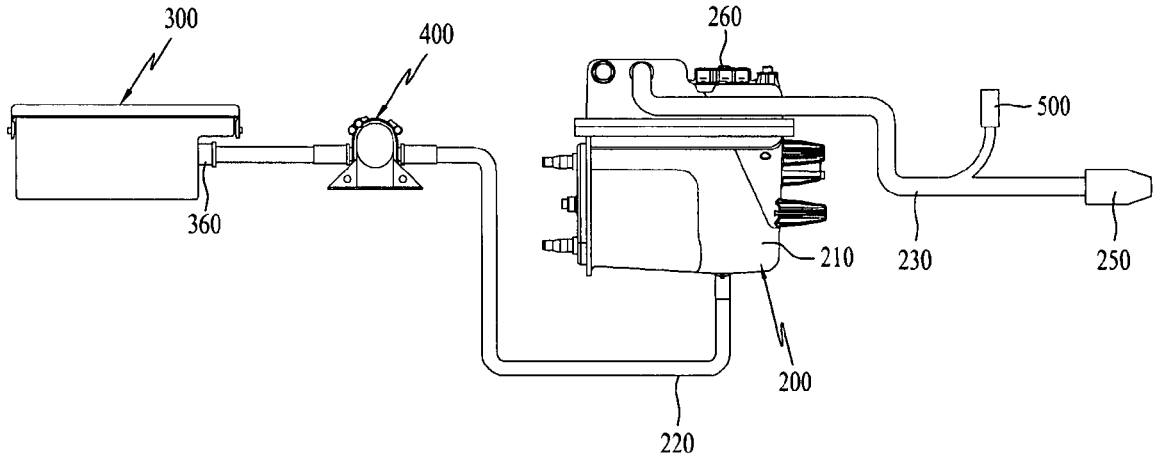
FIG. 2 is a view schematically illustrating the structure of a water supply source, which supplies water, and a steam generator included in the steam laundry dryer according to the embodiment of the present invention shown in FIG. 1.

FIG. 2 is a view schematically illustrating the steam generator of the steam laundry dryer according to the present invention. Hereinafter, the steam laundry dryer according to the present invention will be described with reference to FIG. 2.

The steam generator 200 includes a water tank 210 for storing water, a heater (not shown) mounted in the water tank 210, a water level sensor 260 for sensing the water level in the steam generator 200, and a temperature sensor (not shown) for sensing the temperature in the steam generator 200. Although not shown in the drawing, the water level sensor 260 generally includes a common electrode, a low water level electrode, and a high water level electrode. The water level sensor 260 senses a high water level or a low water level in the steam generator 200 based on the current conduction between the common electrode and the high water level electrode or the current conduction between the common electrode and the low water level electrode.

To one side of the steam generator 200 is connected a water supply hose 220 for supplying water. To the other side of the steam generator 200 is connected a steam hose 230 for discharging steam. To the tip end of the steam hose 230 is preferably mounted a nozzle 250, which is formed in a predetermined shape. Generally, one end of the water supply hose 220 is connected to a water supply source, such as a cartridge 300. The tip end of the steam hose 230 or the nozzle 250, i.e., the steam discharge port, is located at a predetermined position in the drum 20 for spraying steam into the drum 20.

The water supply source may be the cartridge 300, which is fixed to the steam laundry dryer, although not shown in the drawing, or detachably mounted to the steam laundry dryer, as in this embodiment, or may be a faucet mounted at the outside of the steam laundry dryer.

When the water supply source is the faucet, however, the installation of the water supply source is very complicated. This is because water is not generally used in the steam laundry dryer, and therefore, when the faucet is used as the water supply source, it is necessary to install various devices, which are annexed to the faucet. In this embodiment, therefore, the detachable water supply source 300 is used. Specifically, the water supply source 300 is detached from the steam generator 200 so as to fill the water supply source 300 with water. After the water supply source 300 is filled with the water, the water supply source 300 is connected to the water supply channel of the steam generator 200, i.e., the water supply hose 220, which is very convenient.

Between the water supply source 300 and the steam generator 200 is preferably mounted a pump 400. The pump is preferably rotatable in clockwise and counterclockwise directions. Consequently, it is possible to supply water to the steam generator 200, or, if necessary, it is possible to collect the residual water from the steam generator 200. The reason to collect the residual water from the steam generator 200 is that the heater may be damaged due to the residual water in the steam generator 200, or decomposed water may be hereafter used, if the steam generator 200 is not used for a long period of time. Also, a safety valve 500 is preferably mounted on a steam channel for discharging steam from the steam generator 200, i.e., a steam hose 230.

As described above, the pump 400 is mounted in the steam laundry dryer for supplying water from the water supply source 300 to the steam generator 200. However, when a user does not replenish the water supply source 300 with water, the water in the water supply source 300 is insufficient due to the leakage of water from the water supply source 300, or the detachable water supply source 300 is not correctly mounted in the steam laundry dryer, the pump 400 is driven in a state in which the water is insufficient. When the pump 400 is driven in a state in which the water is insufficient, the pump 400 may break.

Also, when the water in the water supply source 300 is insufficient, it is not possible to sufficiently supply water to the steam generator 200, with the result that the heater of the steam generator 200 may be overheated. Furthermore, it is not possible to sufficiently generate steam in the steam generator 200, with the result that steam may not be supplied into the drum 20 of the steam laundry dryer.

Consequently, it is preferable for the steam laundry dryer with the above-stated construction to be operated according to a control method that is capable of determining whether water in the water supply source 300 is insufficient or whether the water supply source 300 is correctly installed to determine whether water is supplied to the steam generator 200.

Hereinafter, a method of controlling the steam laundry dryer depending upon the determination as to whether water is supplied to the pump according to the present invention in the steam laundry dryer with the above-stated construction will be described in detail with reference to the related drawing.

Figure 3:
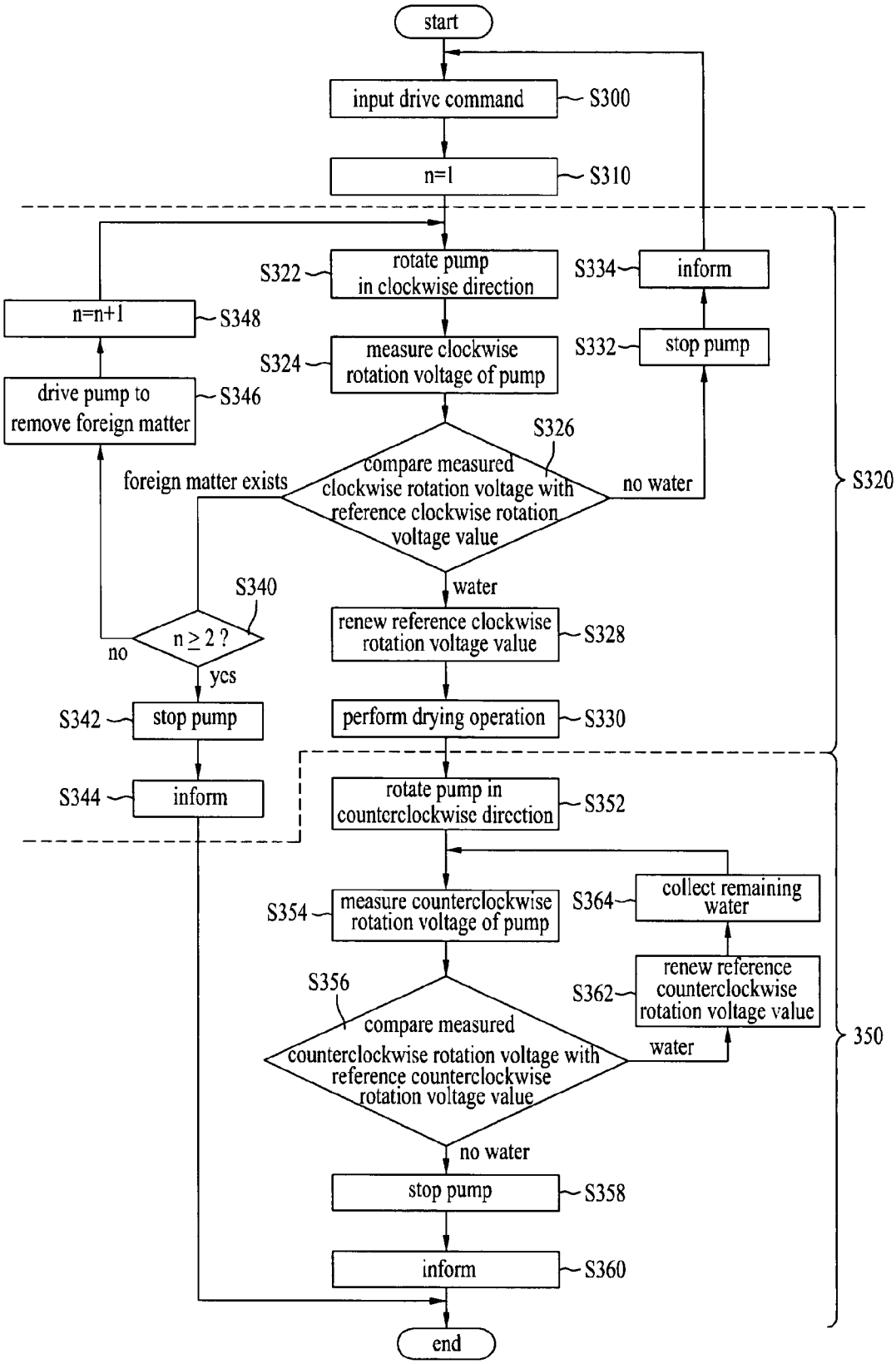
FIG. 3 is a flow chart illustrating a control method of the steam laundry dryer according to an embodiment of the present invention.

FIG. 3 is a flow chart illustrating a control method of the steam laundry dryer according to an embodiment of the present invention.

Referring to FIG. 3, the control method of the steam laundry dryer according to the present invention generally includes a drive command input step of inputting a command to drive the steam laundry dryer (S300), a water supply step (S320) of supplying water from the water supply source 300 (see FIG. 2) to the steam generator 200 (see FIG. 2), and a residual water collection step (S350) of collecting the water residual in the steam generator 200.

The water supply step (S320), i.e., the step of supplying water from the water supply source 300 to the steam generator 200, includes a step of rotating the pump 400 (see FIG. 2) in the clockwise direction (S322), a step of measuring a clockwise rotation voltage value of the pump 400 (S324), a step of determining whether water is supplied to the steam generator 200 using the measured clockwise rotation voltage value (S326), a step of renewing a reference clockwise rotation voltage value (S328), and a step of performing a drying operation (S330).

The residual water collection step (S350), i.e., the step of collecting the water residual in the steam generator 200, includes a step of rotating the pump 400 in the counterclockwise direction (S352), a step of measuring a counterclockwise rotation voltage value of the pump 400 (S354), a step of determining whether water remains in the steam generator 200 using the measured counterclockwise rotation voltage value (S356), and a step of collecting the water residual in the steam generator 200 (S364).

Now, the respective steps will be described in detail.

First, when a user inputs a command to drive the steam laundry dryer according to the present invention (S300), a control unit (not shown) of the steam laundry dryer memorizes a value of "1" in a counter (not shown) (S310). This is to restrict the frequency of driving the pump 400 necessary to remove foreign matter, when the foreign matter is caught in the pump 400, which will be described below in detail.

Subsequently, the procedure advances to the step of supplying water from the water supply source 300 to the steam generator 200 (S320).

Before supplying water to the steam generator 200, the control method according to the present invention determines whether water is sufficiently supplied from the water supply source 300 to the pump 400.

Specifically, the control unit controls the pump 400 to be rotated in the clockwise direction to determine whether water is sufficiently supplied to the pump 400 (S322). In this specification, the clockwise rotation of the pump 400 defines the supply of water from the water supply source 300 to the steam generator 200 by the rotation of the pump 400, whereas the counterclockwise rotation of the pump 400 defines the collection of the residual water from the steam generator 200 to the water supply source 300 by the rotation of the pump 400.

After the pump 400 is rotated in the clockwise direction, the control unit measures the clockwise rotation voltage value of the pump 400 (S324). According to the present invention, the voltage value of the pump 400, which is disposed between the water supply source 300 and the steam generator 200, is measured to determine whether water is supplied to the steam generator 200. More specifically, a current value is measured, during the rotation of the pump, and the measured current value is converted into a voltage value, to determine whether water is supplied to the steam generator 200. Hereinafter, a method of determining whether water is supplied using the measured clockwise rotation voltage value will be described in detail.

Figure 4:
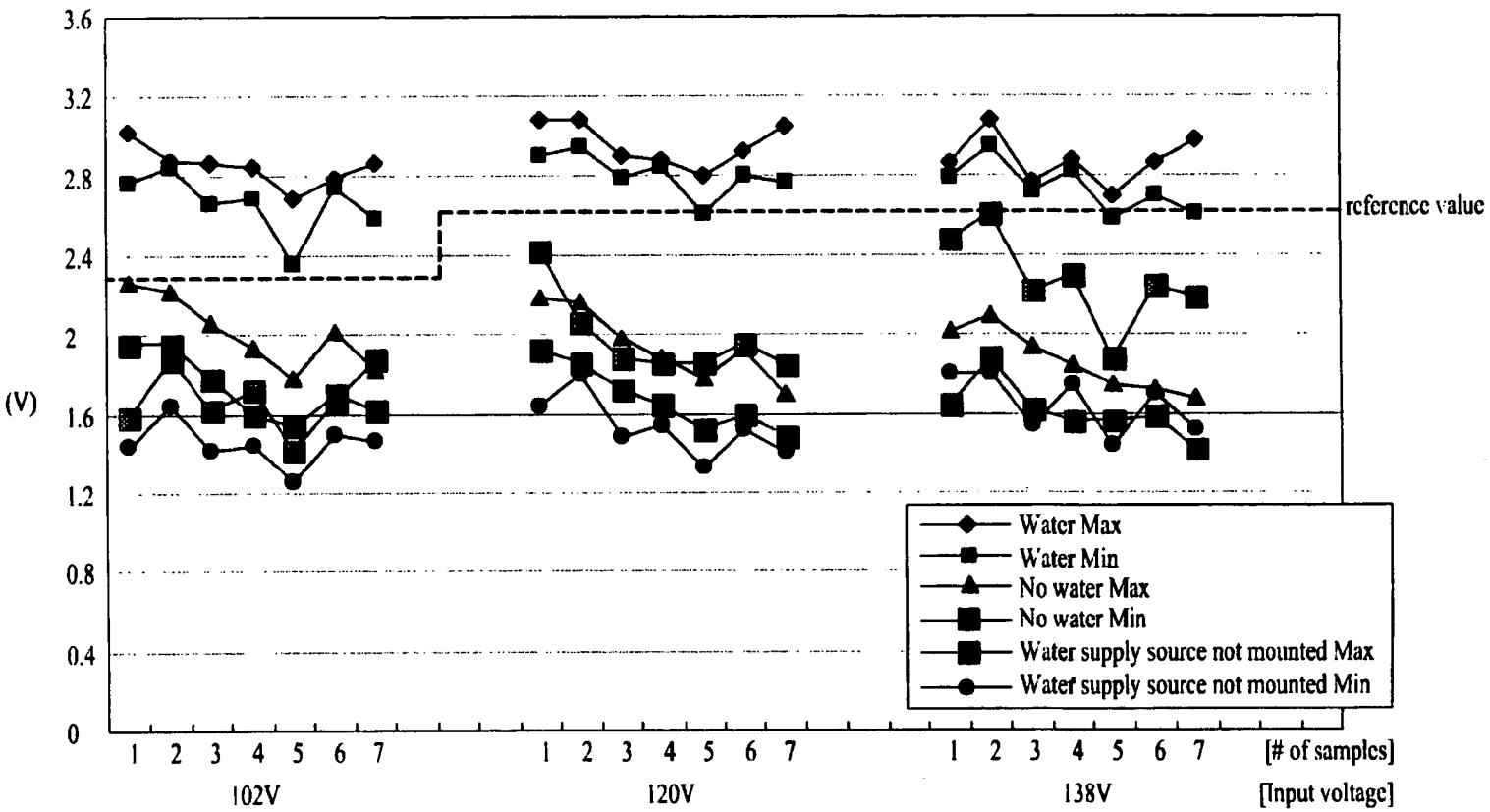
FIG. 4 is a graph illustrating the results of experiments for measuring clockwise rotation voltage values when a plurality of pumps are provided.

The applicant of the present application carried out experiments for measuring clockwise rotation voltage values when a plurality of pumps are provided. FIG. 4 is a graph illustrating the results of the experiments.

As shown in FIG. 4, a total of 7 pumps were used to carry out the experiments, and voltage values for the respective pumps 400 were measured when water existed in the water supply source 300, when no water existed in the water supply source 300, and when the water supply source 300 was not mounted in the steam laundry dryer. In FIG. 4, the horizontal axis indicates the number of the respective pumps (1 to 7) when different voltages, such as 102 V, 120 V, and 138 V, are applied to the pumps, and the vertical axis indicates voltage values measured at the respective pumps.

'Water Max' and 'Water Min' respectively indicate the maximum values and the minimum values of voltages measured at the respective pumps 400 for a predetermined period of time, for example, 6 seconds, when a sufficient amount of water exists in the water supply source 300, and therefore, water is sufficiently supplied to the respective pumps 400.

'No water Max' and 'No water Min' respectively indicate the maximum values and the minimum values of voltages measured at the respective pumps 400 for a predetermined period of time, for example, 6 seconds, when no water exists in the water supply source 300, and therefore, water is not supplied to the respective pumps 400.

'Water supply source not mounted Max' and 'Water supply source not mounted Min' respectively indicate the maximum values and the minimum values of voltages measured at the respective pumps 400 for a predetermined period of time, for example, 6 seconds, when the water supply source is not mounted in the steam laundry dryer, and therefore, water is not supplied to the respective pumps 400.

Referring to FIG. 4, it can be seen that the voltage values for 'Water Max' and 'Water Min', i.e., when water is supplied to the respective pumps 400, and therefore, the respective pumps 400 are driven, are higher than the voltage values for 'No water Max' and 'No water Min' and the voltage values for 'Water supply source not mounted Max' and 'Water supply source not mounted Min', i.e., when water is not supplied to the respective pumps 400. This is because more work is necessary when water is supplied to the respective pumps 400 than when water is not supplied to the respective pumps 400. Also, it can be seen that there is little difference between the voltage values when no water exists in the water supply source 300 and the voltage values when the water supply source 300 is not mounted in the steam laundry dryer.

Referring to FIG. 4, on the other hand, it is possible to establish a specific voltage value as a reference value, when the voltage applied to the respective pumps 400 is uniform, and determine whether water is supplied to the respective pumps 400 through the comparison between the reference value and voltage values measured during the driving of the respective pumps.

For example, when the voltage applied to the respective pumps 400 is 102 V in FIG. 4, it can be seen that, when water is supplied to the respective pumps 400, the smallest value of the maximum values and the minimum values of the voltage values measured at the respective pumps 400 is approximately 2.4 V. Also, it can be seen that, when water is not supplied to the respective pumps 400, the largest value of the maximum values and the minimum values of the voltage values measured at the respective pumps 400 is approximately 2.3 V. Consequently, when the voltage applied to the respective pumps 400 is 102 V, a voltage of approximately 2.3 V is established as the reference value, and, when the voltage values measured during the driving of the respective pumps 400 are greater than the reference value, it is possible to determine that water is supplied to the respective pumps 400. On the other hand, it is possible to determine that water is not supplied to the respective pumps 400 when the measured voltage values are less than the reference value.

However, when the voltage value applied to the respective pumps 400 is changed, it is difficult to determine whether water is supplied to the respective pumps or not based on the reference value that is established as described above, i.e., a voltage of 2.3 V. When the voltage value applied to the respective pumps 400 is changed into 138 V, as shown in FIG. 4, it can be seen that, when water is supplied to the respective pumps 400, the smallest value of the maximum values and the minimum values of the voltage values measured at the respective pumps 400 is approximately 2.6 V. Also, it can be seen that, when water is not supplied to the respective pumps 400, the largest value of the maximum values and the minimum values of the voltage values measured at the respective pumps 400 is approximately 2.5 V. Consequently, when the voltage applied to the respective pumps 400 is 138 V, a voltage of approximately 2.3 V is established as the reference value, it is determined that water is supplied to the respective pumps 400 even when water is supplied to the respective pumps 400.

Figure 5:
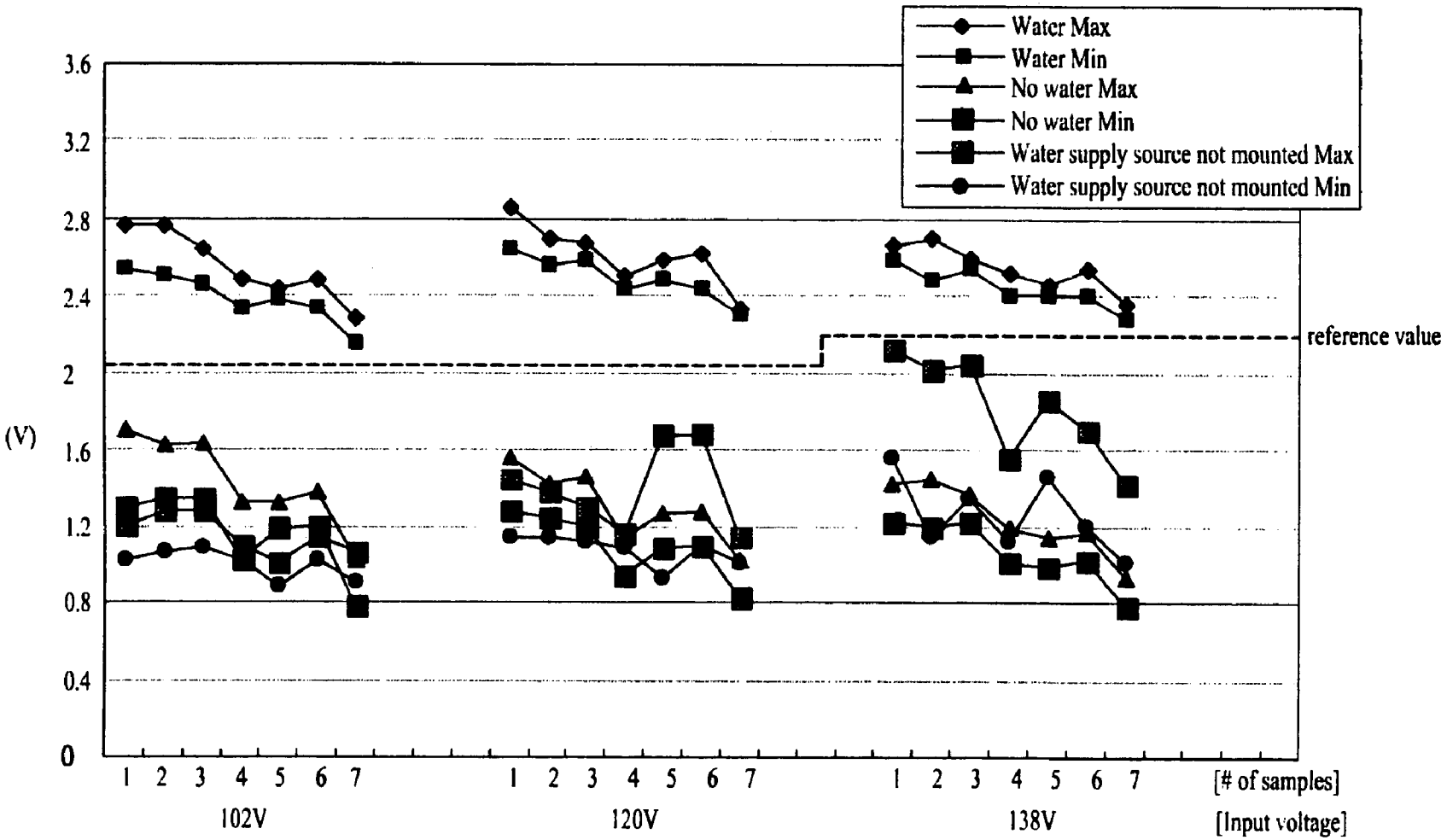
FIG. 5 is a graph illustrating the results of experiments for measuring counterclockwise rotation voltage values when a plurality of pumps are provided.

Meanwhile, the above problem also occurs in the same manner when the pumps 400 are rotated in the counterclockwise direction. FIG. 5 is a graph illustrating counterclockwise rotation voltage values measured at the respective pumps 400 when the respective pumps are rotated in the counterclockwise direction. The experiment conditions of FIG. 5 are identical to those of FIG. 4 except that the respective pumps 400 are rotated in the counterclockwise direction. FIG. 5 shows the collection of the residual water from the steam generator 200 through the counterclockwise rotation of the respective pumps 400. Consequently, 'Water' or 'No water' indicates whether water remains in the steam generator 200.

Referring to FIG. 5, even in a case in which the respective pumps 400 are rotated in the counterclockwise direction, it can be seen that it is difficult to determine whether water remains in the steam generator 200 based on a specific voltage value established as the reference value, when the voltage applied to the respective pumps 400 is changed.

Referring to FIGS. 4 and 5, it can be seen that, when the voltage applied to the respective pumps 400 is changed, there is a difference between the absolute values of the voltage values when water is supplied to the respective pumps 400 and the absolute values of the voltage values when water is not supplied to the respective pumps 400. However, it can be seen that, when the voltage applied to the respective pumps 400 is changed, there is little difference between the relative values of the voltage values when water is supplied to the respective pumps 400 and the relative values of the voltage values when water is not supplied to the respective pumps 400. That is, as shown in FIGS. 4 and 5, it can be seen that the difference between mean values of the voltage values when water is supplied to the respective pumps 400 and mean values of the voltage values when water is not supplied to the respective pumps 400 is approximately uniformly maintained.

Consequently, the present invention determines whether water is supplied to the respective pumps based on the difference between the mean values of the voltage values when water is supplied to the respective pumps and the mean values of the voltage values when water is not supplied to the respective pumps. Hereinafter, the control method according to the present invention will be described in detail through the structure of the control unit.

Specifically, the control unit (not shown) of the steam laundry dryer according to the present invention includes a storage part as shown in FIG. 6.

The storage part includes a first storage part 620 for storing previously inputted clockwise and counterclockwise rotation voltage values, a second storage part 640 for storing a reference clockwise rotation voltage value and a reference counterclockwise rotation voltage value, and a third storage part 660 for storing clockwise and counterclockwise rotation voltage values of the pump 400 newly measured through the driving of the pump 400.

The first storage part 620 stores pluralities of previously measured clockwise and counterclockwise rotation voltage values of the pump 400, when the pump 400 is rotated in the clockwise and counterclockwise directions. In other words, when water exists in the water supply source 300 and the steam generator 200, clockwise and counterclockwise rotation voltage values of the pump 400 measured by the driving of the pump 400 are previously stored in the first storage part 620.

As shown in FIG. 6, the clockwise and counterclockwise rotation voltage values are alternately stored in the first storage part 620. For example, as shown in the drawing, it is possible to store five pairs of clockwise and counterclockwise rotation voltage values.

Meanwhile, it is preferable to input values measured by experiments into the first storage part 620 of the control unit before the steam laundry dryer according to the present invention is put on the market. In other words, it is preferable to previously input clockwise and counterclockwise rotation voltage values measured through the driving of the pump 400, when water exists in the water supply source 300 and the steam generator 200, into the first storage part 620, before the steam laundry dryer according to the present invention is put on the market.

When the clockwise and counterclockwise rotation voltage values are previously inputted as described above, the control unit calculates mean values of the stored clockwise and counterclockwise rotation voltage values, through a calculating part (not shown), and stores the calculated mean values in the second storage part 640. In other words, mean values of the previously inputted clockwise and counterclockwise rotation voltage values are calculated, the calculated mean values are stored in the second storage part 640 as reference clockwise and counterclockwise rotation voltage values. Consequently, the steam laundry dryer according to the present invention is put on the market while clockwise and counterclockwise rotation voltage values are previously stored in the first storage part 620, and mean values of pluralities of previously inputted clockwise and counterclockwise rotation voltage values are stored in the second storage part 640 as the reference clockwise and counterclockwise rotation voltage values.

On the other hand, when the steam laundry dryer is operated, and it is determined whether water exists in the water supply source 300, the control unit rotates the pump 400 in the clockwise direction to measure a clockwise rotation voltage value, and stores the measured clockwise rotation voltage value in the third storage part 660.

The control unit compares the measured clockwise rotation voltage value with the reference clockwise rotation voltage value previously stored in the second storage part 640 to determine whether water is supplied to the pump (S326) (see FIG. 3). As described above, the difference between the mean value of the voltage values when water is supplied to the pump and the mean value of the voltage values when water is not supplied to the pump is approximately uniformly maintained. Consequently, it is possible to determine that water is supplied to the pump when the measured clockwise rotation voltage value is within a predetermined range of the reference clockwise rotation voltage value although the voltage value applied to the pump 400 is changed. For example, when the measured clockwise rotation voltage value is within ±0.5 to 1.0 V of the reference clockwise rotation voltage value, it is determined that water is normally supplied to the pump 400. According to the present invention, a value corresponding to the determination range is set to 0.5 to 1.0; however, the value corresponding to the determination range is not limited, and therefore, the value may be appropriately changed.

According to the present invention, when the measured clockwise rotation voltage value is within the predetermined range of the reference clockwise rotation voltage value, the reference clockwise rotation voltage value is renewed (S328) (see FIG. 3).

When the measured clockwise rotation voltage value is within the predetermined range of the reference clockwise rotation voltage value, the control unit newly stores the measured clockwise rotation voltage value in the first storage part 620. In this case, when the storage space of the first storage part 620 is sufficient, it is possible to store the newly measured clockwise rotation voltage value in the first storage part 620 without deletion of the clockwise rotation voltage value previously stored in the first storage part 620. Consequently, when the measured clockwise rotation voltage value is newly stored in the first storage part 620, the control unit newly calculates a mean value of the clockwise rotation voltage values stored in the first storage part 620, through the calculating part, and stores the newly calculated mean value in the second storage part 640 as a new reference clockwise rotation voltage value.

Generally, the storage space of the first storage part 620 is restricted. Consequently, when the measured clockwise rotation voltage value is stored in the first storage part 620, it is preferable to delete one of the clockwise rotation voltage values previously stored in the first storage part 620. Specifically, when the measured clockwise rotation voltage value is stored in the first storage part 620, a predetermined number of clockwise rotation voltage values, for example, five clockwise rotation voltage values as shown in FIG. 6, are preferably stored in the first storage part 620.

When one of the previously stored clockwise rotation voltage values is deleted as described above, it is preferable to delete the clockwise rotation voltage value initially stored in the first storage part 620. This is because, when the steam laundry dryer is operated, and the voltage value of the pump is measured, there may be a difference between voltage values actually measured by a user during the use of the steam laundry dryer and voltage values measured through tests before the steam laundry dryer is put on the market. Consequently, it is possible to more accurately determine whether water is supplied to the pump by calculating a mean value of the voltage values actually measured during the use of the steam laundry dryer and establishing the mean value of the voltage values as the reference clockwise rotation voltage value.

Consequently, the control unit deletes the clockwise rotation voltage value previously stored in the first storage part 620 and newly stores the measured clockwise rotation voltage value in the first storage part 620, calculates a mean value of the clockwise rotation voltage values stored in the first storage part 620 through the calculation part, establishes the mean value of the clockwise rotation voltage values as the reference clockwise rotation voltage value, and stores the mean value of the clockwise rotation voltage values, as the reference clockwise rotation voltage value, in the second storage part 640.

In the control method according to the present invention, therefore, a comparison between the voltage value measured at the pump and the specific reference value is not made, but it is determined whether the measured voltage value is within the predetermined range of the reference voltage value to determine whether water is supplied to the pump. Consequently, it is possible to accurately determine whether water is supplied to the pump even when the voltage applied to the pump 400 is changed.

Also, the reference clockwise rotation voltage value and the reference counterclockwise rotation voltage value are continuously renewed and stored when water is normally supplied to the pump such that the pump is driven. Specifically, the reference clockwise rotation voltage value and the reference counterclockwise rotation voltage value are continuously renewed by the voltage values measured during the actual use of the steam laundry dryer, whereby it is possible to more accurately determine whether water is supplied to the pump.

Referring back to FIG. 3, the control unit renews the reference clockwise rotation voltage value, and then controls the steam laundry dryer to perform a drying operation (S330). The drying operation includes at least one process for generating hot air by the hot air heater 90, supplying the generated hot air into the drum 20, and supplying steam, generated by the steam generator 200, into the drum 20.

Meanwhile, when the measured clockwise rotation voltage value is less, by the value of the predetermined range, than the reference clockwise rotation voltage value, at the step of comparing the measured clockwise rotation voltage value with the reference clockwise rotation voltage value (S326), the control unit determines that water is not supplied to the pump 400.

For example, when the measured clockwise rotation voltage value is less, by 0.5 to 1.0 V, than the reference clockwise rotation voltage value, the control unit determines that water is not supplied to the pump 400. In this case, the control unit does not perform the step of storing the measured clockwise rotation voltage value or renewing the reference clockwise rotation voltage value.

When the control unit determines that water is not supplied to the pump 400, the control unit stops the driving of the pump 400 to prevent the breakage of the pump 400 (S332), and informs a user that water is not supplied to the pump 400 (S334). Consequently, the steam laundry dryer according to the present invention preferably includes a display unit or a speaker, through which the user is informed that water is not supplied to the pump. Through the display unit or the speaker, the user recognizes that water is not supplied to the pump 400, and therefore, it is possible to check the water supply source 300 and to fill the water supply source 300 with water or to perform other appropriate actions.

On the other hand, when the measured clockwise rotation voltage value is greater, by the value of the predetermined range, than the reference clockwise rotation voltage value, at the step of comparing the measured clockwise rotation voltage value with the reference clockwise rotation voltage value (S326), the control unit determines that foreign matter is caught in the pump 400 or the flow channel between the pump 400 and the steam generator 200 is clogged.

For example, when the measured clockwise rotation voltage value is greater, by 0.5 to 1.0 V, than the reference clockwise rotation voltage value, which means that more power is supplied than when water is supplied to the pump 400, the control unit determines that foreign matter is caught in the pump 400, and therefore, the pump 400 is not normally driven, or the flow channel between the pump 400 and the steam generator 200 is clogged. In this case, the control unit determines that foreign matter is caught in the pump 400, and performs a controlling operation for removing the foreign matter.

In order to remove the foreign matter, the control unit compares the value of the counter, which was previously described, with a predetermined value (an integer of 2 or more) to determine whether the value of the counter is equal to or greater than, for example, 2 (S340). Since the value stored in the counter is memorized as '1' at the step S 310, as previously described, the value of the counter is less than the predetermined value, for example, '2', at the comparison step (S340). Specifically, when the value stored in the counter is '1', the control unit determines that the driving of the pump to remove the foreign matter is initially performed, and drives the pump to remove the foreign matter (S346).

The driving of the pump to remove the foreign matter is carried out several times in alternating directions. Specifically, the pump is alternately rotated in the clockwise and counterclockwise direction. As a result, the foreign matter is removed from the pump 400 (S346).

Subsequently, the value stored in the counter of the control unit is increased by 1 (S348). Consequently, after the step of performing the pump driving process to remove the foreign matter (S346) is initially carried out, the value stored in the counter is increased to '2'.

Subsequently, the pump is rotated in the clockwise direction (S322), the voltage of the pump is measured (S324), and the measured voltage value is compared with the reference clockwise direction voltage value to determine whether water is supplied to the pump (S326).

Consequently, the control unit compares the measured voltage value with the reference clockwise direction voltage value, at the determination step (S326), to perform the following step, as previously described. On the other hand, when it is determined at the determination step (S326) that the measured voltage value is greater by a predetermined value than the reference clockwise direction voltage value, the control unit determines that the foreign matter has not been removed although the pump 400 was driven to remove the foreign matter. In this case, i.e., when it is determined that the foreign matter is still caught in the pump 400, the following step is carried out according to the frequency of the pump driving process to remove the foreign matter.

Specifically, the value stored in the counter of the control unit is compared with the predetermined value, for example, 2 (S340). When the value stored in the counter of the control unit is 2 or more, it is determined that the foreign matter determination step is carried out secondly. Consequently, the pump driving process to remove the foreign matter is not performed, the pump is stopped (S342), and a user is informed that the pump is stopped (S344). This corresponds to a case in which the pump 400 is still abnormal although the pump driving process to remove the foreign matter has been performed once, for example, a case in which it is difficult to remove the foreign matter by the pump driving process to remove the foreign matter or in a case in which the flow channel between the pump and the steam generator is clogged. Consequently, it is preferable to inform the user of the above-mentioned abnormality, such that repair is carried out, instead of further carrying out the pump driving process to remove the foreign matter.

Also, the predetermined value, which is compared with the value stored in the counter of the control unit at the step of comparing the value stored in the counter of the control unit with the predetermined value (S340), may be appropriately changed. Specifically, it is possible to appropriately change the predetermined value in consideration of the area where the steam laundry dryer is installed, the weather, or the like, and therefore, it is possible to appropriately change the number of repetitions of the step of performing the pump driving process to remove the foreign matter (S346).

After the drying operation is completed, the residual water collection step (S350) of collecting the water residual in the steam generator 200 is carried out.

The residual water collection step (S350) includes the step of rotating the pump 400 in the counterclockwise direction (S352), the step of measuring the counterclockwise rotation voltage value of the pump 400 (S354), the step of determining whether water remains in the steam generator 200 using the measured counterclockwise rotation voltage value (S356), and the step of collecting the water residual in the steam generator 200 (S364). Hereinafter, the respective steps will be described in detail.

In order to collect the residual water from the steam generator 200, the control unit controls the pump 400 to be rotated in the counterclockwise direction (S354) and measures a counterclockwise rotation voltage value of the pump 400 (S354).

Subsequently, the control unit compares the measured counterclockwise rotation voltage value with the reference counterclockwise rotation voltage value previously stored in the second storage part 640 (see FIG. 6) to determine whether water is supplied to the pump when the residual water exists in the steam generator 200 (see 2), and therefore, the pump 400 is rotated in the counterclockwise direction (S356).

The determination of that the residual water exists in the steam generator 200 when the measured counterclockwise rotation voltage value is within the predetermined range of the reference counterclockwise rotation voltage value and the determination of that the residual water does not exist in the steam generator 200 when the measured counterclockwise rotation voltage value is less than the predetermined range of the reference counterclockwise rotation voltage value are similar to the determination using the clockwise rotation voltage value, which was previously described, and therefore, a detailed description thereof will not be given.

When it is determined that the residual water exists in the steam generator, at the step of determining that the residual water exists in the steam generator, and therefore, water is supplied to the pump, the control unit renews the reference counterclockwise rotation voltage value using the measured counterclockwise rotation voltage value (S362). A method of renewing the reference counterclockwise rotation voltage value is similar to the method of renewing the reference clockwise rotation voltage value, and therefore, a detailed description thereof will not be given.

After renewing the reference counterclockwise rotation voltage value, the control unit controls the pump 400 to be rotated in the counterclockwise direction such that the water residual in the steam generator 200 is discharged to the water supply source 300 (S364).

Meanwhile, it is preferable that the control unit periodically measures the counterclockwise rotation voltage value of the pump 400, at the residual water discharge step (S364), to compare the measured counterclockwise rotation voltage value with the reference counterclockwise rotation voltage value. This is because, when the measured counterclockwise rotation voltage value is less, by the value of the predetermined range, than the reference counterclockwise rotation voltage value, at the residual water discharge step, it is determined that the residual water does not exists in the steam generator 200, and the driving of the pump 400 is stopped to prevent the breakage of the pump 400 (S358). Also, the user is informed that the residual water does not exist in the steam generator 200 (S360), and the operation of the steam laundry dryer is stopped.

In this embodiment, the water supply source 300 is detachably mounted to the steam laundry dryer; however, the present invention is not limited to the detachable water supply source 300. For example, the water supply source 300 may be fixedly mounted to the steam laundry dryer. Even in this case, i.e., when the water supply source is fixedly mounted to the steam laundry dryer, the voltage value of the pump, located between the water supply source and the steam generator, may be measured to determine whether water is supplied to the pump.

As apparent from the above description, steam is sprayed to dry clothes in the steam laundry dryer according to the present invention. Consequently, the steam laundry dryer according to the present invention has the effect of effectively remove crumples or wrinkles from the clothes without ironing.

Also, it is determined that water is supplied to the pump, after the steam laundry dryer according to the present invention is operated, and then the pump is driven. Consequently, the steam laundry dryer according to the present invention has the effect of preventing the idling of the pump, thereby preventing the breakage of the pump.

Also, the voltage value measured when the pump is driven is not compared with the specific reference value, but it is determined whether the measured voltage value is within the predetermined range of the reference value to determine whether water is supplied to the pump. Consequently, the steam laundry dryer according to the present invention has the effect of accurately determining whether water is supplied to the pump or not even when the voltage value applied to the pump is changed.

Furthermore, the reference voltage value is continuously renewed using the voltage value measured when water is supplied to the pump. Consequently, the steam laundry dryer according to the present invention has the effect of more accurately calculating the reference value when the steam laundry dryer is continuously used.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A control method of a laundry machine, the control method comprising:

starting supplying water from a water supply source, which is detachably mounted to the laundry machine, to a fine water-droplet generator;

operating a pump configured to pump water from the water supply source to the fine water-droplet generator;

measuring a current value during the operation of the pump and converting the current value into a voltage value; and comparing the voltage value with a first reference voltage value and sensing using the compared result whether water in the water supply source is insufficient or the water supply source is not mounted to the laundry machine.

2. The control method according to claim 1, wherein the first reference voltage value is a mean value of voltage values of the pump.

3. The control method according to claim 1, wherein the sensing further includes sensing that water is normally supplied to the fine water-droplet generator when the measured voltage value is within a predetermined range of the first reference voltage value.

4. The control method according to claim 3, further comprising:

renewing the first reference voltage value by using the measured voltage value.

5. The control method according to claim 4, wherein the renewing includes calculating a mean value of the measured voltage value and previously stored voltage values and storing the calculated mean value in the control unit as a new first reference voltage value.

6. The control method according to claim 5, wherein the renewing further includes deleting one of the previously stored voltage values and storing the measured voltage value in the control unit.

7. The control method according to claim 1, further comprising:

operating the pump reversely to collect residual water from the fine water-droplet generator; and sensing whether the residual water still remains.

8. The control method according to claim 7, wherein the sensing whether the residual water still remains includes measuring a voltage value of the pump when the pump is reversely operated; and comparing the measured voltage value with a second reference voltage value.

9. The control method according to claim 8, wherein the second reference voltage value is a mean value of measured voltage values.

10. The control method according to claim 8, wherein the sensing whether the residual water still remains further includes sensing that the residual water remains in the fine water-droplet generator, by the control unit, when the measured voltage value is within a predetermined range of the second reference voltage value.

11. The control method according to claim 10, further comprising renewing the second reference voltage value by using the measured voltage value.

12. The control method according to claim 11, wherein the renewing includes calculating a mean value of the measured voltage value and previously stored voltage values; and storing the calculated mean value in the control unit as a new second reference voltage value.

13. The control method according to claim 10, wherein the sensing whether the residual water still remains further includes sensing that the residual water does not remain in the fine water-droplet generator, by the control unit, when the measured voltage value is less, by a value of a predetermined range, than the second reference voltage value.

14. The control method according to claim 13, further comprising:

stopping the driving of the pump when it is sensed that the residual water does not remain.

15. The control method according to claim 1, wherein the sensing further includes sensing that water is not normally supplied to the fine water-droplet generator, by the control unit, when the measured voltage value is less, by a value of a predetermined range, than the first reference voltage value.

16. The control method according to claim 15, further comprising:

stopping the driving of the pump when it is sensed that water is not normally supplied to the fine water-droplet generator.

17. The control method according to claim 1, wherein the sensing further includes sensing that the pump is abnormal, by the control unit, when the measured voltage value is greater, by a value of a predetermined range, than the first reference voltage value.

18. The control method according to claim 17, wherein the sensing further includes sensing that foreign matter is caught in the pump and the method further comprises performing a pump driving process to remove the foreign matter by the control unit.

19. The control method according to claim 18, wherein the pump driving process is carried out by repeatedly operating the pump in a alternating fashion of forward driving and reverse driving for a predetermined number of times.

20. The control method according to claim 1, wherein the fine water-droplet generator includes a steam generator to generate steam to supply into a drum.

21. A control method of a laundry machine, the control method comprising:

starting supplying water from a water supply source, which is detachably mounted to the laundry machine and configured to store water, to a fine water-droplet generator operating a pump configured to pump water from the water supply source to the fine water-droplet generator;

measuring a current value during the operation of the pump and converting the current value into a voltage value; and comparing the voltage value with a first reference voltage value and sensing using the compared result whether water is normally being supplied to the fine water-droplet generator or not, wherein it is sensed that the water is not normally being supplied to the fine water-droplet generator when the water in the water supply source is insufficient or the pump is blocked or the water supply source is not mounted to the laundry machine.

22. The control method according to claim 21, wherein the fine water-droplet generator includes a steam generator to generate steam to supply into a drum.

23. The control method according to claim 21, wherein it is sensed that the water is not normally supplied to the fine water-droplet generator when the measured voltage value is less or greater, by a value of a predetermined range, than the first reference voltage value.

* * * * *